US005442867A

United States Patent [19]

Robinson

[11] Patent Number: 5,442,867

[45] Date of Patent: Aug. 22, 1995

[54] COMBINATION DRYING UNIT

[76] Inventor: Joe M. Robinson, 1334 Timberlane Rd., Tallahassee, Fla. 32312

[21] Appl. No.: 373,849

[22] Filed: Jan. 18, 1995

[51] Int. Cl.[6] ..... E03C 1/04; F26B 19/00

[52] U.S. Cl. ..... 34/90; 34/202; 392/380

[58] Field of Search ..... 34/90, 427, 202; 392/380

[56] References Cited

U.S. PATENT DOCUMENTS

| | | | |
|---|---|---|---|
| 3,305,938 | 2/1967 | Goldstein . | |
| 3,495,342 | 2/1970 | Goldstein | 392/380 X |
| 3,587,437 | 6/1971 | McEwen | 98/1 |
| 3,643,346 | 2/1972 | Lester | 34/202 |
| 3,785,523 | 1/1974 | Goldstein | 221/42 |
| 4,336,619 | 6/1982 | Hinkel et al. | 34/90 X |
| 4,999,929 | 3/1991 | Dutton | 34/202 X |
| 5,031,337 | 7/1991 | Pilollu et al. | 34/44 |
| 5,197,589 | 3/1993 | Gordon | 194/248 |

*Primary Examiner*—Edward K. Look
*Assistant Examiner*—Hoang Nguyen
*Attorney, Agent, or Firm*—Peter Loffler

[57] ABSTRACT

A combination drying unit is disclosed. The device consists of a air blower unit that forces air out through a venting system in order to dry a person's hands and face. After completion of the air blowing process, a paper towel roll, mounted within the drying unit, dispenses a single paper towel out though the bottom of the unit.

7 Claims, 5 Drawing Sheets

FIG. 14
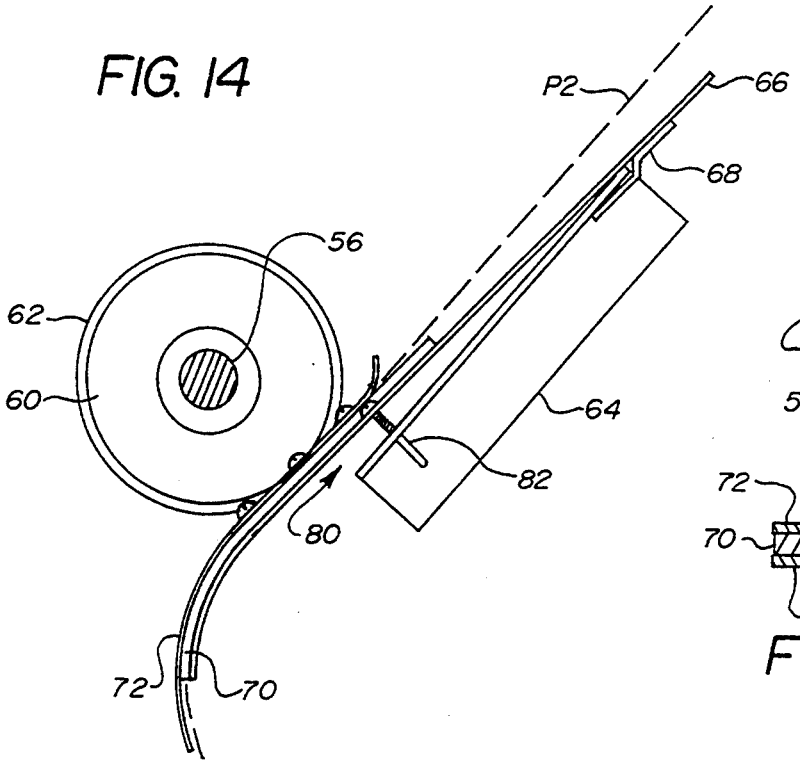
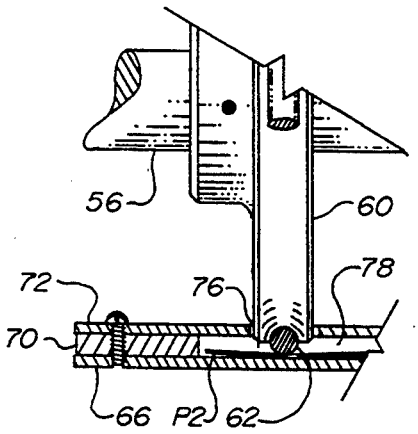
FIG. 15
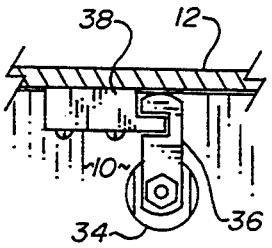
FIG. 16
FIG. 13
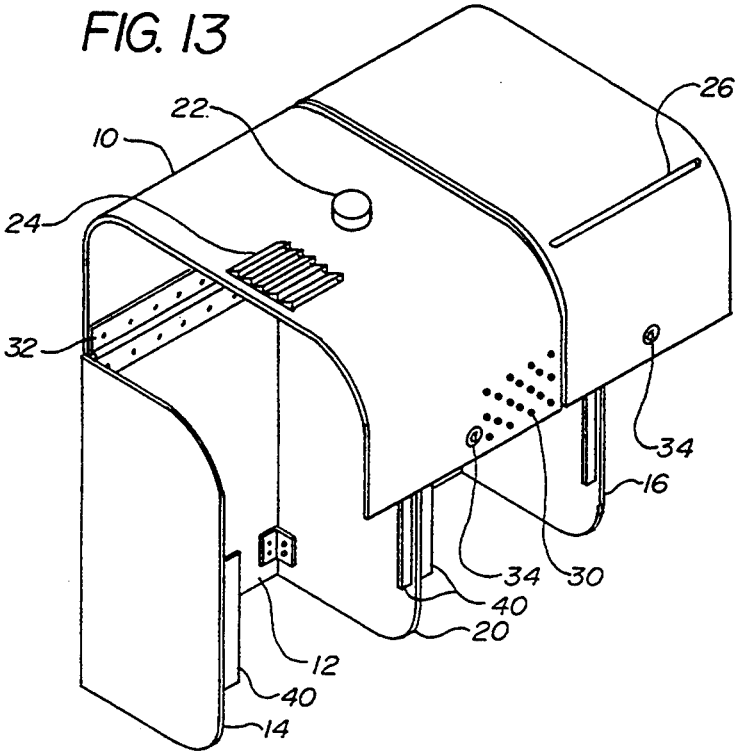

COMBINATION DRYING UNIT

BACKGROUND OF THE INVENTION

1. Field of the Invention

The present invention relates to a combination dryer that blows air onto a user's hands and face to dry them and thereafter dispenses a single paper towel to finish the drying process.

2. Background of the Prior Art

One of the tasks performed during a visit to a public bathroom is washing the hands and face. After washing, the hands and face must be dried. The drying process is performed in one of three general ways: cloth towels; paper towels; and air dryers.

Cloth towels usually are the best performers in the drying field. They tend to remove the most water and dampness from the user's skin. However, the use of cloth towels in a public bathroom setting presents the most problems.

For sanitary reasons, towels cannot be reused and each person must be provided with a fresh towel. This involves giving each person either a new independent towel or the use of the a towel roll, wherein a continuous towel is stored on a roller and the user pulls down a fresh section. The former is prohibitively expensive while the latter, perceived as less than completely sanitary, has fallen into disfavor. Therefore, the use of cloth towels has disappeared from all but the most exclusive settings.

The use of paper towels is a suitable alternative to the use of cloth towels. Paper towel dispensers give each person a fresh clean sheet of paper to dry the hands and face. After use, the paper towel is simply discarded. Several different types of paper towel dispensers are available.

The problem with paper towel dispenser is cost, both of the towel and of disposal. Generally, several sheets of paper towels are required in order to completely dry the hands and face. With each patron using several sheets, the costs of providing the paper towels and thereafter disposing of the discarded towels, can be quite large, especially in high volume areas such as hotels, restaurants, and airports.

A second problem with paper towel dispensers is that the user will tend to withdraw more paper than is required. This is not only a waste of scarce resources, it also further increases system costs.

In order to control costs of hand and face drying, many establishments use air dryers. These devices blow air, usually heated, onto the user's hands and face for a fixed period of time, usually a few seconds. Recent improvements in this art, such as in U.S. Pat. No. 5,031,337 issued to Pilolia et. al., provide automatic on and off control for the units.

While this drying method eliminates the need for costly paper towels, it leaves the user less than completely satisfied. After using such a device, a person's skin is still damp. In order for the device to completely dry the skin, the device must be used for an extended period of time. Most people are not willing to wait this length of time. Although the air dryers are economical, they suffer from low user satisfaction.

There is a definitive need for a public bathroom hand and face dryer that is both economical and which leaves the user satisfied and feeling dry. Such a device should be inexpensive to build and maintain.

U.S. Pat. No. 3,785,523 issued to Goldstein provides a combination drying unit that dispenses both heated air and sheets of C-shaped towels. The Goldstein device fails to provide for the use of the more conventional paper towel rolls.

SUMMARY OF THE INVENTION

The present invention meets the above needs for an economical and efficient hand and face drying device. The invention calls for a drying unit that blows air for a set period of time and thereafter automatically issues the user a single paper towel, from a standard paper towel roll, to complete the drying process.

The device consists of a housing unit. Located within the housing unit is an air dispensing chamber and a paper dispensing chamber. The air dispensing chamber houses an air blower that blows air out of the housing unit to the user.

The present invention allows the air blower to have an optional heater. Construction of the device of the present invention without the heater achieves further manufacture and operating cost reductions.

Located within the paper dispensing unit are means to hold a roll of paper towels. A motor, housed within the air dispensing unit, controls dispensing of the paper towel roll out of the bottom of the housing unit.

Upon the triggering of a control switch, located on the front cover of the housing unit, the air blower blows air toward the user. The user uses the air stream to dry his hands and face.

After expiration of a predetermined number of seconds, the air blower turns off. Thereafter, the motor turns on for a predetermined number of seconds. The motor causes a stream of paper from the paper towel roll to be dispensed out through the bottom of the housing unit. This leaves the user a single paper towel of a predetermined length available for the drying process. In order to receive a second sheet of paper, the user must complete the entire cycle over again.

Because the device uses an air blower for part of the drying process, the unit is economical over a standard paper dispenser. Since the user will use a paper towel to complete the drying process, a high level of user satisfaction is achieved. As most people will not wait for the repetition of an entire cycle, most users will receive only a single paper towel sheet thereby realizing a substantial savings in the use of paper towels by the owners of the device.

Therefore, it is the object of the present invention to provide a combination drying unit that is economical to operate and manufacture.

It is another object of the present invention to provide a combination drying unit that reduces the use of paper towels in the hand and face drying process in public bathrooms.

It is another object of the present invention to provide a combination drying unit that achieves a high level of user satisfaction.

It is a final object of the present invention to provide a combination drying unit that uses a standard paper towel roll.

BRIEF DESCRIPTION OF THE DRAWINGS

FIG. 13 is a perspective view of the housing unit with the front cover in a raised position.

FIG. 14 is a side view of the paper feeding mechanism.

FIG. 15 is a partial view of a feed wheel disposed within the channel.

FIG. 16 is a view of the locking mechanism of the device.

Similar reference numerals refer to similar parts throughout the several views of the drawings.

DETAILED DESCRIPTION OF THE PREFERRED EMBODIMENT

Figure 1:
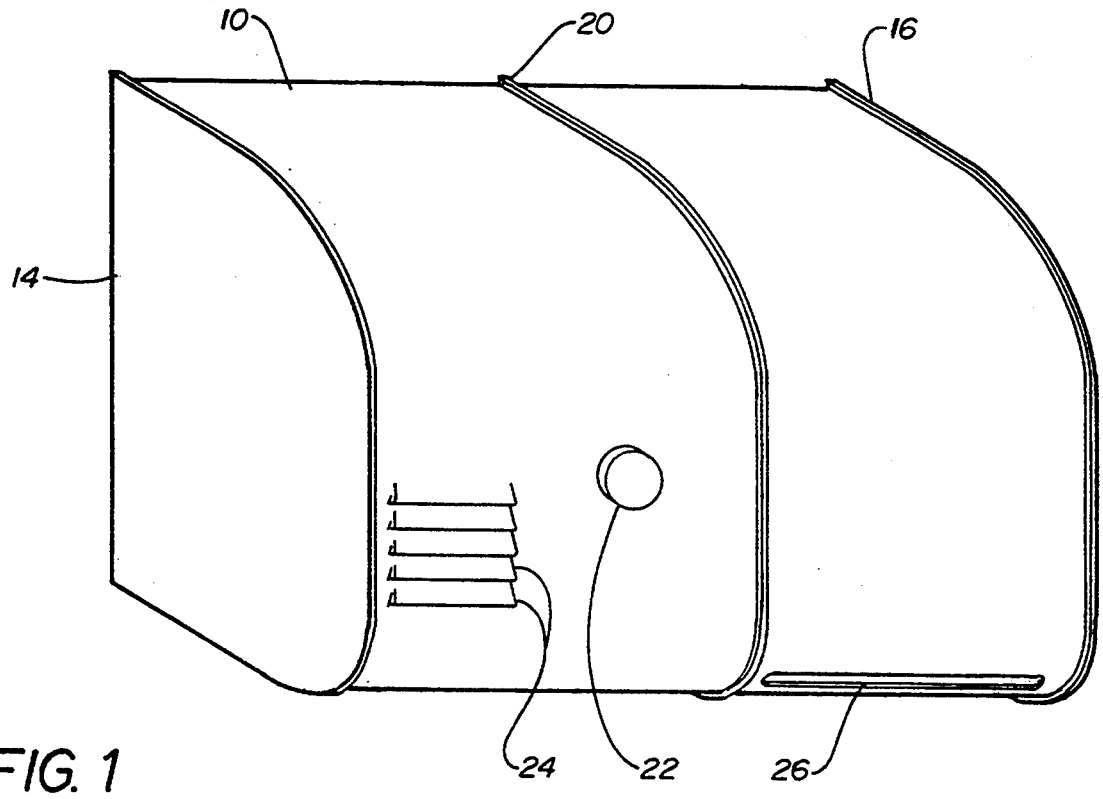
FIG. 1 is a perspective view of the device of the present invention.
Figure 2:
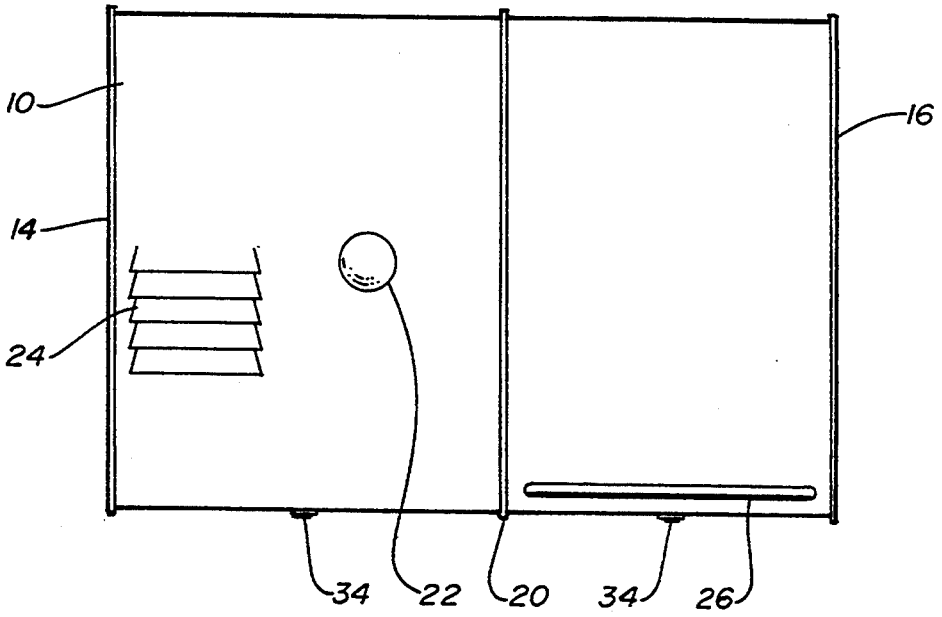
FIG. 2 is a front elevation view of the device of the present invention.
Figure 3:
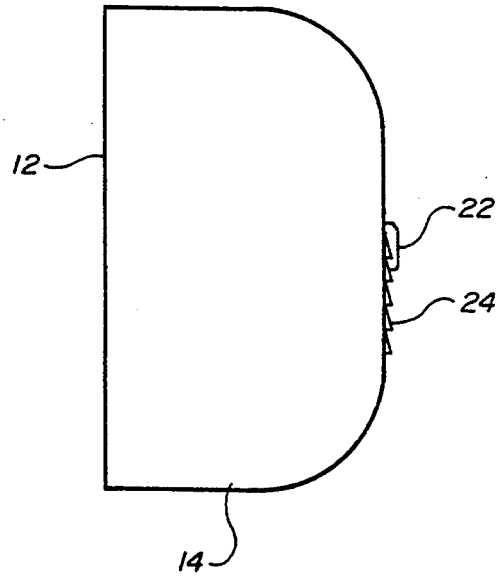
FIG. 3 is a left elevation view of the device of the present invention.
Figure 4:
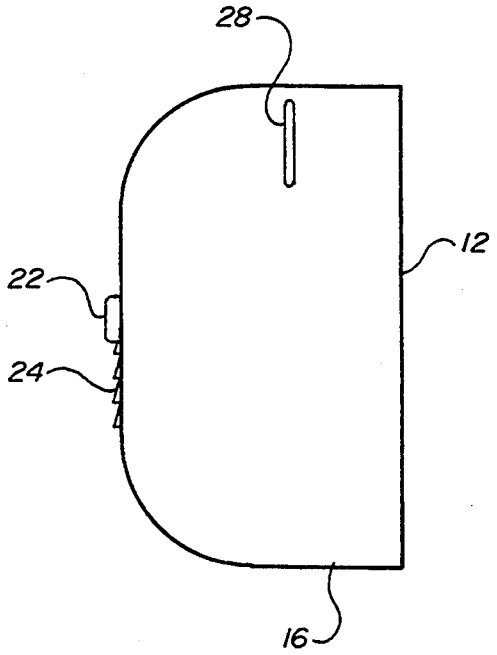
FIG. 4 is a right elevation view of the device of the present invention.
Figure 5:
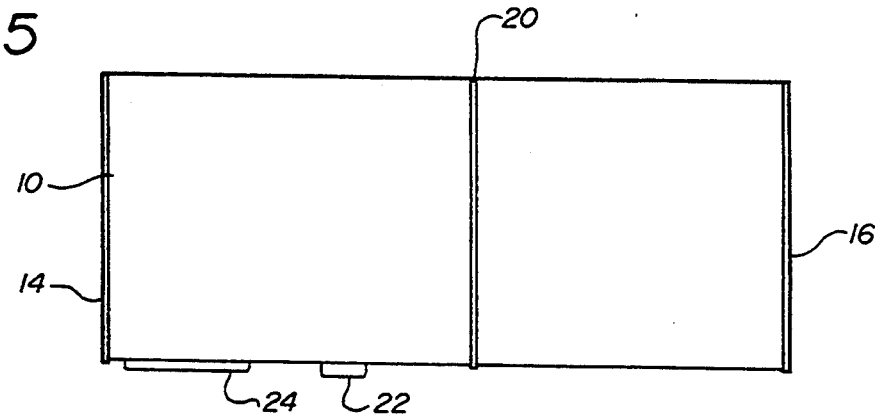
FIG. 5 is a top view of the device of the present invention.
Figure 6:
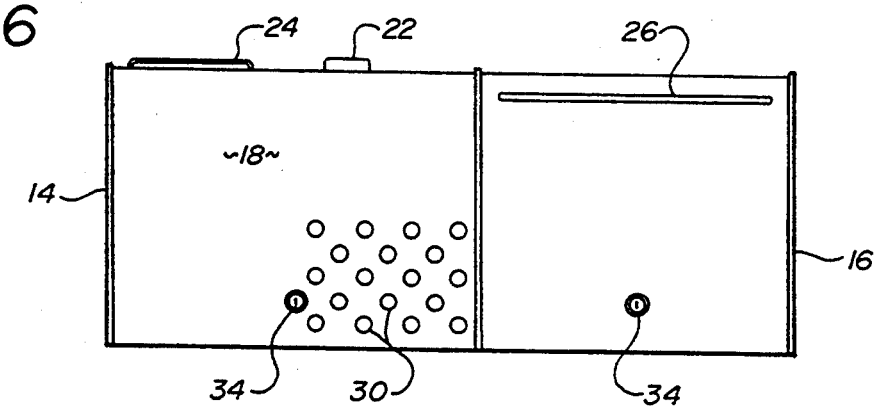
FIG. 6 is a bottom view of the device of the present invention.

FIGS. 1–6 illustrate the outside of the housing of the combination dryer of the present invention. As seen, the housing consists of a front cover 10, back plate 12, left side plate 14, right side plate 16, a bottom portion 18, and a partition plate 20. Located on front cover 10 is a switch 22, a series of louvered air vents 24, and a paper opening 26. Located on the right side plate 16 is a paper view aperture 28. Located on the bottom portion 18 is a series of air intake apertures 30.

The front cover 10 is attached to the back plate 12 by hinge means 32. Located on the bottom of the front cover 10, is a pair of locks 34, one lock 34 on either side of the front cover 10. A pair of lock bars 38 are attached to the back plate 12, one lock bar 38 on either side of the back plate. In order to lock down the front cover to the back plate 12, the arm 36 of each lock 34 engages its respective lock bar (as illustrated in FIG. 16). This holds the front cover 10 in a closed position. In order to unlock the front cover 10 from the back plate 12, the arm 36 of each lock 34, disengages from its respective lock bar 38.

Figure 7:
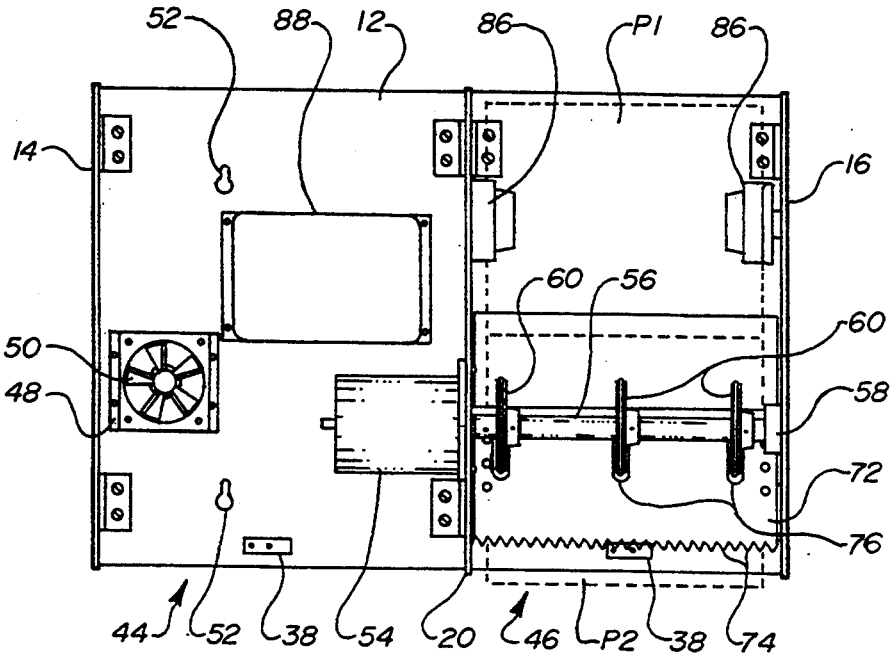
FIG. 7 is a view of the internal configuration of the device of the present invention.
Figure 8:
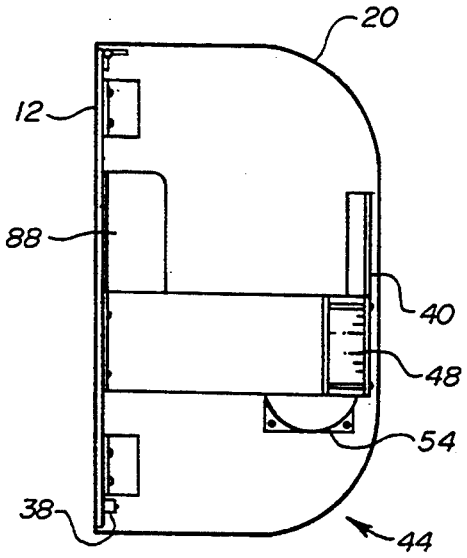
FIG. 8 is a left side elevation view of the air dispensing chamber.
Figure 9:
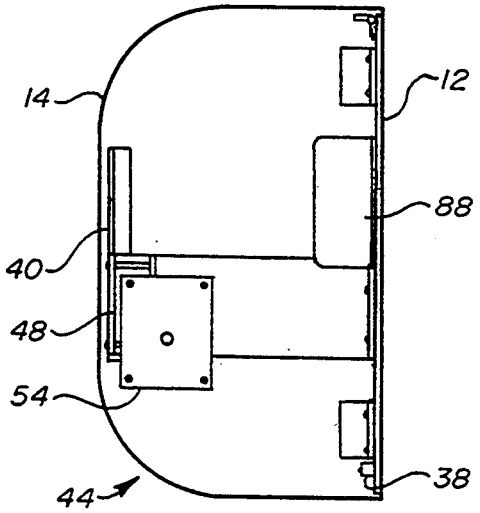
FIG. 9 is a right side elevation view of the air dispensing chamber.
Figure 10:
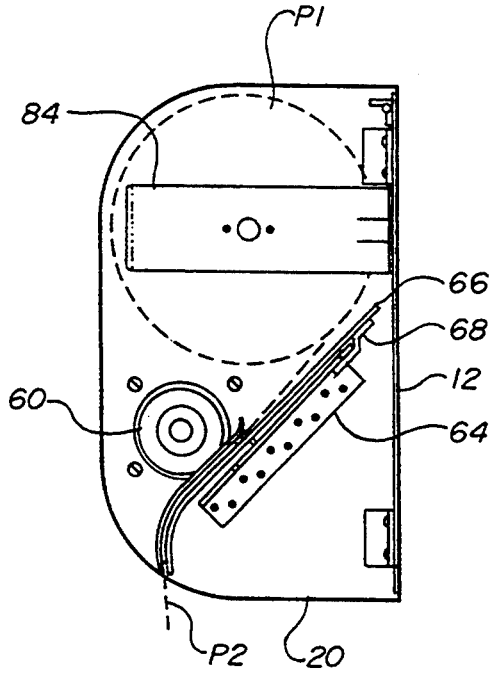
FIG. 10 is a right side elevation view of the paper dispensing chamber.

Stop brackets 40 located on the left plate 14, right plate 16 and the partition plate 20 help to hold the front cover 10 firmly in place when it is in a closed position FIG. 7 illustrates the interior of the device. As seen, the interior is divided into two chambers, an air dispensing chamber 44 located on the left, and a paper dispensing chamber 46 located on the right. The partition plate 20, attached to the back plate 12, separates the two chambers and provides support for the devices within.

Located within the air dispensing chamber 44 is an air blower 48. The air blower 48 is a motorized air blower of a commercially available type. The air blower 48 dispenses air through its air outlet 50. The air blower 48 can optionally have a heating element (not shown) near the air outlet 50 in order to dispense heated air. The air blower 48 is attached to the back plate 12. The air blower 48 is configured so that air dispensed through the air outlet 50, is directed through the louvered air vents 24. If necessary, an air duct (not shown) can be provided so that the dispensed air is directed through the louvered air vents 24. It is understood by those skilled in the art that other devices, such as a positionally adjustable nozzle, can be substituted for the air vents 24.

Located on the back plate 12, within the air dispensing chamber 44, is a pair of apertures 52. A second pair of apertures (not shown) are located on the back plate 12 within the paper dispensing chamber 46. These apertures 52 allow the device to be screwed or otherwise attached to a wall or similar structure.

Also located within the air dispensing chamber 44 is a motor 54. The motor 54 is affixed to the partition plate 20. Extending outwardly from the motor 54, into the paper dispensing chamber 46 is a shaft 56. The end of the shaft 56 is attached to a pillow box bearing 58. The pillow box bearing 58 is attached to the right side plate 16 and permits rotation of the shaft 56.

Located on the shaft 56 is a plurality of evenly spaced feed wheels 60. Encompassing the outer circumference of each feed wheel 60 is an 0-ring 62. Each 0-ring 62 is made of a soft durable material such as rubber or neoprene.

Attached to the partition plate 20 is a diagonally disposed paper bracket 64. A second paper bracket (not shown) is attached to the right side plate 16 and is aligned with the first paper bracket.

FIG. 14 illustrates a paper plate 66. The paper plate 66 is a relatively flat plate member. Attached to the bottom side of the paper plate 66 are a pair of clips 68, one clip on either side. Attached to the top side of the paper plate 66 is a pair of spacers 70. One spacer is located on the left side of the paper plate 66 and one spacer is located on the right side of the paper plate 66. Attached to the top of the spacers 70 is a plate cover 72. The bottom end of the plate cover 72 has a serrated edge 74. The plate cover 72 has a series of openings 76. Each opening 76 corresponds to a feed wheel 60. The feed wheels 60 protrude through the openings 76.

When the plate cover 72 is attached to the spacers 70 a long thin channel 78 is formed. The paper plate 66 forms the bottom boundary of the channel 78, the cover 72 forms the top boundary of the channel 78, one spacer 70 forms the left boundary of the channel 78 and the other spacer 70 forms the right boundary of the channel 78.

The bottom ends of the paper plate 66, spacers 70, and plate cover 72 are curved downwardly. The top end of the plate cover 72 is curved upwardly. The components of the channel—paper plate 66, spacers 70, and plate cover 72—are attached to the paper brackets 64 such that the clips 68 hook onto the end of the paper brackets 64, one clip 68 per paper bracket 64. When the paper plate 66 is attached to paper brackets 64, a gap 80 is formed between the bottom of the paper plate 66 and the top side of each paper bracket 64, at the paper brackets' bottom ends. A pair of adjustment screws 82 passes threw the paper plate 66 and the paper bracket 64. The adjustment screws 82 adjust the dimensions of the gap 80.

Attached to the back plate 12, above the paper brackets 68, is a pair of core brackets 84, one core bracket 84 on the right side of the paper dispensing chamber 46, and one core bracket (not illustrated) on the left side of the paper dispensing chamber 46. Attached to the ends of each core bracket 84 is a core plug 86. The core brackets 84 are disposed so that the core plugs 86 are aligned with one another. A standard paper towel roll P1 is put onto the core plugs 86 so that the paper towel roll's core (not illustrated) is attached onto the core plugs 86. When so attached, the paper towel roll P1 will be free to rotate about the core plugs 86.

In order to install the paper towel roll P1 onto the core plugs 86, the core brackets 84 can be made of a flexible material. The core brackets 84 can be flexed back to installation or removal of the paper towel roll P1 onto or from the core plugs 86. Alternatively, the core bracket 84 can be attached to the back plate 12 by a spring loaded hinge (not illustrated). In order to install or remove a paper towel roll P1, the right side core bracket is swung outwardly, toward the right side plate 14, giving the paper towel roll P1 clearance from the core plugs 86. Once the paper towel roll P1 is installed (or removed), the spring-loaded hinge returns the core bracket 84 back to its original position.

When the paper towel roll P1 is installed onto the core plugs 86, its loose paper end is fed through the channel 78. The curved upper portion of the plate cover 72 guides the loose paper end of the paper towel roll P1 into the channel 78. The paper stream P2 is passed underneath the 0-rings 62 of the feed wheels 60 and then passed out through the paper opening 26. The adjustment screw 82 is adjusted so that the feed wheels 64 will friction feed the paper stream P2 through the channel 78 when the feed wheels rotate. Paper P2 dispensed through the paper opening 26, is separated from the main paper towel roll P1 by pulling on the dispensed paper P2. This causes the loose paper end P2 to be pulled along the serrated edge, cutting the paper P2 and separating it from the main paper towel roll P1, leaving the user a single sheet of paper.

It is expressly recognized that the adjustment screw 82 can be replaced by a pair of springs (not illustrated). One spring is disposed between the top of each paper bracket 64 and the paper plate 66. The springs automatically adjust the dimension of the gap 80, assuring that the paper stream P2 is friction fed through the channel.

Figure 11:
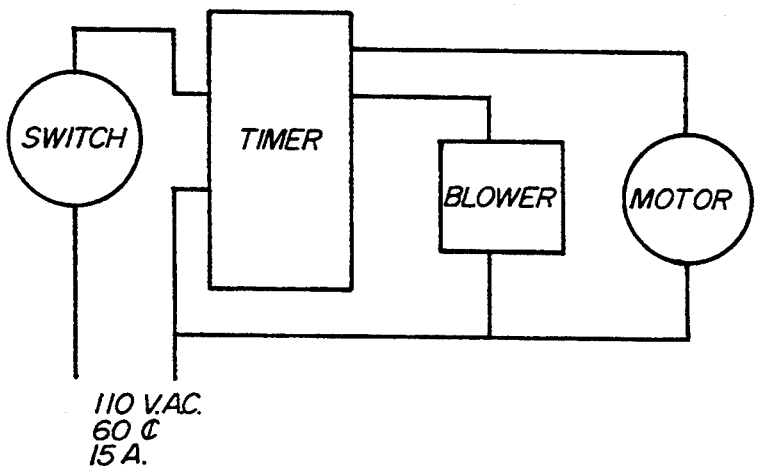
FIG. 11 is a schematic diagram of the timer control.

A timer 88 is attached to the back plate 12 inside the air dispensing chamber 46. As seen in FIG. 11, the timer 88 is in electrical communication with the switch 22, the air blower 48, and the motor 54. The timer 88 is designed so that when the switch 22 is depressed, the air blower 48, is turned on for a preset number of seconds. The air blower 48 blows air out through the air vents 24. After expiration of the preset number of seconds, the timer 88 turns the air blower 48 off and turns the motor 54 on for a preset number of seconds. When the motor 54 is turned on, it rotates the shaft 56, which in turn rotates the feed wheels 60. The turning feed wheels 60 friction feed the paper stream P2 through the paper opening 26. After expiration of the preset number of seconds, the timer 88 turns the motor 54 off.

Figure 12:
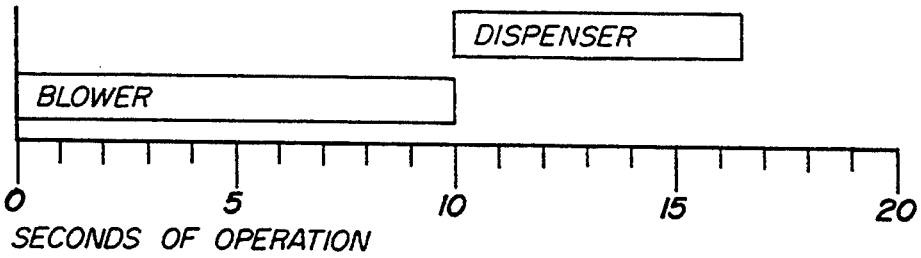
FIG. 12 is a timing diagram of device operation.

FIG. 12 illustrates this operational cycle. The switch 22 is depressed at time zero. The blower operates for ten seconds and turns off. Coincidentally, the motor (labeled dispenser in FIG. 12) is turned on for six seconds and then turns off. The function of the switch 22 is disabled during this operation cycle, and depression of the switch 22 during the cycle will have no affect on the length of either the air blower cycle or the motor cycle. The times of the air blower cycle and the motor cycle are shown by example. It is expressly understood that either cycle may be lengthened or shortened as required.

The operational cycle gives the user several seconds of blown air by which to dry his hands. Thereafter, several inches of paper are dispensed.

This proves to be both economical and satisfying, as it gives the user blown air to start the drying process and paper to finish the drying process. By being given paper for the drying process, the user is left dry and satisfied. By controlling the amount of paper dispensed, operation of the device is economical.

While the invention has been particularly shown and described with reference to embodiments thereof, it will be understood by those skilled in the art that various changes in form and detail may be made without departing from the spirit and scope of the invention.

I claim:

1. A combination drying unit comprising;

a housing unit;

an first aperture is located on the front of said housing unit;

an air blower means is located within said housing unit;

said air blower unit blows air through said first aperture;

a paper holder means is located within said housing unit;

said paper holder means holds a standard paper towel roll and permits said paper towel roll to rotate about said paper holder means;

a second aperture located on said front of said housing unit;

dispensing means for unraveling said paper towel roll wherein when said paper towel roll is unraveled, the loose paper end of said paper towel roll passes through said second aperture;

a switch located on the front of said housing unit;

control means for controlling said air blower means and said dispensing means; and wherein the triggering of said switch causes said air blower means to activate for a preset amount of time and thereafter causes said air blower means to deactivate and immediately thereafter causes said dispensing means to activate for a preset amount of time and thereafter causes said dispensing means to deactivate.

2. The device as in claim 1 to further include an air heater;

said air heater causes said blown air to be heated before it is discharged through said first aperture.

3. The device as in claim 1 wherein said dispensing means comprises;

a plate;

said loose paper end of said paper towel roll passes over said plate;

a motor;

a shaft protrudes from the end of said motor;

a plurality of feed wheels are equally spaced long the length of said shaft;

said plurality of feed wheels communicate with said loose paper end of said paper towel roll;

wherein said motor is activated by the triggering of said switch causing said feed wheels to rotate and thereby friction feed said loose paper end of said paper towel roll along said plate; and said plate guides said loose paper end of said paper towel roll out through said second aperture.

4. The device as in claim 3 wherein an O-ring encompasses the outer circumference of each of said feed wheels.

5. The device as in claim 3 to further include adjustment means;

said adjustment means adjusts the coefficient of friction established between said feed wheels and said plate.

6. The device as in claim 1 to further include a serrated strip;

said serrated strip is located at said second aperture; and wherein said discharged paper towel roll is pulled along said serrated strip in order to disengage said loose paper end from said paper towel roll.

7. The device as in claim 1 to further include a third aperture;

said third aperture is located on the side of said housing unit; and said third aperture is used to view said paper towel roll installed within said housing unit.

* * * * *